US005261746A

United States Patent [19]

Boasso

[11] Patent Number: 5,261,746

[45] Date of Patent: Nov. 16, 1993

[54] METHOD OF TRANSPORTING AND BLENDING SLURRIES WITH AN OSCILLATING PADDLE SYSTEM

[76] Inventor: Walter J. Boasso, 27 W. Pamela Pl., Arabi, La. 70032

[21] Appl. No.: 22,078

[22] Filed: Feb. 24, 1993

Related U.S. Application Data

[63] Continuation of Ser. No. 676,322, Mar. 28, 1991, abandoned.

[51] Int. Cl.[5] ..... B01F 11/00

[52] U.S. Cl. ..... 366/276; 366/292; 366/325

[58] Field of Search ..... 366/13, 61, 64, 67, 366/160, 192, 250, 276-278, 290-292, 299, 309, 312-313, 328, 329, 243, 325; 99/277.2, 348

[56] References Cited

U.S. PATENT DOCUMENTS

| | | | |
|---|---|---|---|
| 8,764 | 2/1852 | Weed | 366/290 X |
| 627,968 | 7/1899 | Benbow | 366/276 X |
| 901,024 | 10/1908 | McKeon | 366/64 |
| 2,059,080 | 10/1936 | Blake | 366/278 X |
| 2,556,014 | 6/1951 | Tolman | 366/290 |
| 2,650,807 | 9/1953 | Bilek | 99/348 X |
| 2,772,784 | 12/1956 | Cyphers et al. | 366/309 X |
| 2,869,840 | 1/1959 | Schmidt | 366/309 X |
| 3,216,345 | 11/1965 | Rigby et al. | 366/160 X |
| 3,469,948 | 9/1969 | Anderson et al. | 366/103 X |
| 3,672,958 | 6/1972 | McCandlish | 366/278 X |
| 3,731,339 | 5/1973 | Addison | 366/312 X |
| 4,416,545 | 11/1983 | Krimmel | 366/61 X |
| 4,473,001 | 9/1984 | Rieger | 366/278 X |
| 4,522,499 | 6/1985 | Hudelmaier | 366/228 X |
| 4,599,004 | 7/1986 | Keith | 366/292 X |

FOREIGN PATENT DOCUMENTS

| | | | |
|---|---|---|---|
| 8101249 | 5/1981 | PCT Int'l Appl. | 366/279 |
| 1050731 | 10/1983 | U.S.S.R. | 366/292 |
| 965222 | 7/1964 | United Kingdom | 366/250 |
| 1051692 | 12/1966 | United Kingdom | 366/61 |

*Primary Examiner*—Harvey C. Hornsby
*Assistant Examiner*—Charles Cooley
*Attorney, Agent, or Firm*—Joseph T. Regard

[57] ABSTRACT

A method of transporting and processing a viscous slurry, mash, or insoluble in a liquid carrier wherein there is provided a container having a paddle system disposed therein, the paddle system configured to oscillate in a limited, back and forth fashion so as to lift and shift the fluid mass toward a center portion of the container interior via gravity, and to a bottom portion thereof for recirculation and blending. The method further includes a coupling piece connected to the paddle system, and a portable drive system, the method steps including transporting the container filled with the insoluble and liquid carrier, coupling the portable drive system to the coupling piece, and actuating the portable drive system for oscillating the paddle system via the coupling piece.

2 Claims, 2 Drawing Sheets

FIG. 4
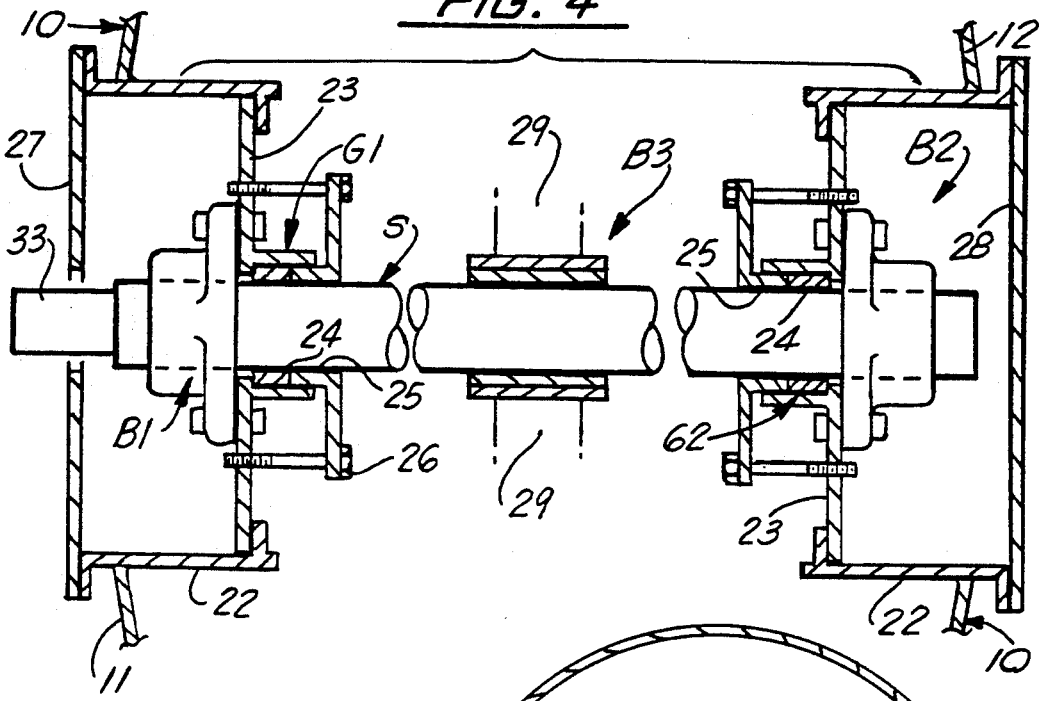
FIG. 5
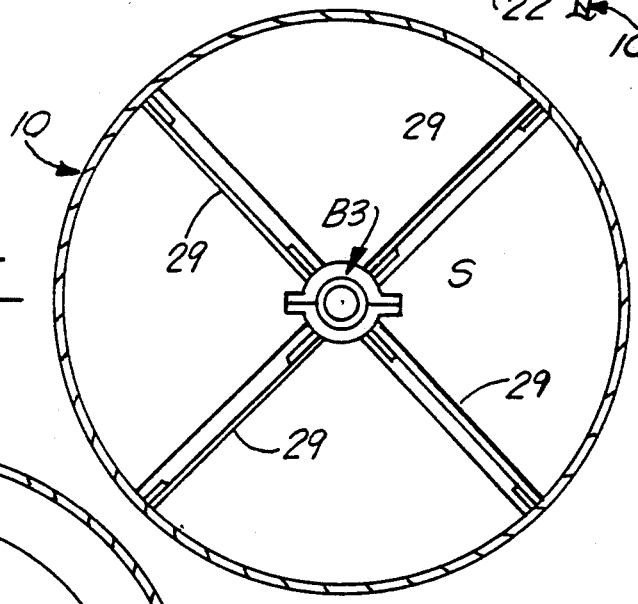
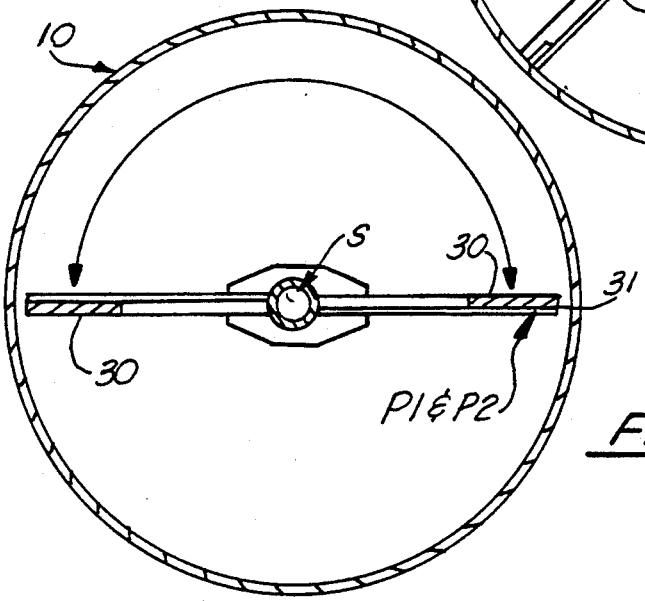
FIG. 6

METHOD OF TRANSPORTING AND BLENDING SLURRIES WITH AN OSCILLATING PADDLE SYSTEM

STATEMENT OF CONTINUING APPLICATION

The present application is a continuation of an earlier filed application entitled "Container-Blender for Mixing Slurries", having a filing date of Mar. 28, 1991 and Ser. No. 07/676,322 (now abandoned), and listing Walter J. Boasso as the inventor.

BACKGROUND OF THE INVENTION

This invention relates to the transit and delivery of viscous slurries such as a mash comprised of insolubles carried in a liquid. Shipping such a commodity dictates the use of bulk containers, whether transported by truck, rail or by vessel, in which case large volumes of viscous slurry separates during transit with the settlement or flotation of insolubles from the liquid carrier, with the result that blending and off-loading procedures become difficult if not impossible. For example, Tobasco Pepper Sauce is transported in very large containers as a mash mixed with salt and water and permitted to ferment over an extended period of time, after which the mash is drained and then mixed with vinegar to set for a short period of time. The resulting slurry is then churned so as to be thoroughly mixed, and finally the insoluble seeds and skins are strained off, with no other ingredients added, to then be bottled. It is significant that there be uniformity of this commodity, and that it be maintained in a substantially fluid state or condition. The usual shipments of pepper mash consist of massive two thousand gallon batches.

It is a longitudinally disposed container of cylinderical configuration with which this invention is concerned, a container adapted to transport and/or store a commodity during shipment and/or processing, and especially non homogenous slurries such as pepper mash or the like. Heretofore, such a mash has settled out with the heavier insolubles accumulating at the bottom of the container cylinder, resulting in non uniformity of product and rendering the commodity unmanageable. That is, the mixture to be withdrawn at the bottom of the container is unpredictably balanced and not always acceptable, and the accumulation of solids is such as to inhibit off-loading and often prevents discharge from the container. Accordingly, it is an object of this invention to provide agitation by which the accumulation of insolubles is lifted from the bottom of the container and admixed with liquid at a higher level in the container. Further, it is an object of this invention to provide agitation by which the lift of insolubles shifts the same toward the center of the container. In practice, there are paddles that lift insolubles from the bottom of the container and simultaneously shift the same from opposite ends of the container and toward the center portion thereof.

Mixers and agitators have been motorized to rotate continuously in one direction of rotation, and they have been oscillated to break through a conjested mass. However, there has been an absence of oscillation to lift and shift insolubles toward a center portion of such containers. Continuous one-way rotation is objectionable, as it simply moves conjested masses circularly but without longitudinal displacement. Therefore, it is an object of this invention to provide longitudinal shift of conjested insolubles, so that they admix with longitudinally adjacent masses thereof and with the less viscous liquid carrier. Consequently, a uniform admixture is inherently attained with the elimination of conjested masses of the insolubles. As a result, the blend or mix remains acceptable as required, and off-loading proceedures are not impaired.

It is an object of this invention to controllably oscillate the aforesaid paddles, whereby the lift and shift functions are attained. In practice, the paddles rotate on a central longitudinally disposed axis, internally of the container, and with one end of a drive shaft exposed for coupled engagement with an oscillating drive means. Said drive means can vary as required and is adapted to oscillate in opposite directions of rotation so as to alternately move the paddles in reverse directions of rotation ranging, for example, from 90° to 360° of motion. In practice, a hydraulic drive motor is employed for this purpose as will be described.

It is another object of this invention to provide a removable and replaceable oscillating drive means, one that can be removed during transit or off periods of time, and replaced for further processing or off-loading. Continued agitation during shipment may or may not be necessary and power for motorization unavailable. Furthermore, the presence of mechanical equipment can invite vandalism and abuse. Therefore, it is highly advantageous to provide adaptability and separability at the receiver end of shipment, and the commodity expediently off-loaded. Accordingly, the oscillating drive means is a replacable unit that is releasably attached to the container by coupling it to the paddle drive shaft.

SUMMARY OF THE INVENTION

This invention provides a container and blender for in-transit and off-loading mixing and/or processing of viscous slurries having insoluble solids therein. As above described, a commodity that can be processed and transported in this Container-Blender is pepper mash, in process and transported in the preparation of Tobasco Pepper Sauce. That is, the container is charged with pepper mash admixed with salt and water in a massive batch in which fermentation takes place during both storage and transport. Insofar as is necessary, mixing or churning is to be applied during an extended period of time, the detachable oscillating drive means being applied and operated as required. Or, said batch can be transported and off-loaded into a suitable vat and stored for the duration of a time period. The container is an elongated horizontally disposed cylinder in a frame of shipboard dimension, a cylinder 6½ foot diameter and 19½ foot length. The container is stationary in the frame and has an access-loading hatch of sizable dimension to receive the massive batch of commodity for transport and blending. A drive shaft extends coextensively of the center axis of the container cylinder, and is carried by opposite end bearings and a center support bearing, with coupling means exposed at one end at the exterior of the container. In accordance with this invention, the drive shaft carries a paddle system in each end portion of the container cylinder, reversely driven by an oscillating drive means to recirculate the slurry away from the bottom area and toward the center area of the container cylinder. The drive means is a removable and replaceable unit, preferably a hydraulic cylinder and piston drive having adjustable rotation capability. The paddle system is characterized by a wall sweeping function that effectively lifts conjested insolubles, forcing them to rise and seek equilibrium by virtue of gravitation toward the center portion or area of the container. Said lift and shift functions occur alternately at opposite end portions of the container, moving insolubles inwardly and downwardly at the center portion of the container and then oppositely outward along the bottom of the container. Rotation of the insolubles within the container is compensated for by commensurate reversal within the limited range of oscillation as above stated.

The foregoing and various other objects and features of this invention will be apparent and fully understood from the following detailed description of the typical preferred form and application thereof, throughout which description reference is made to the accompanying drawings.

THE DRAWINGS

FIG. 4 is an enlarged sectional view of the shaft support and access of the paddle system.

Figure 1:
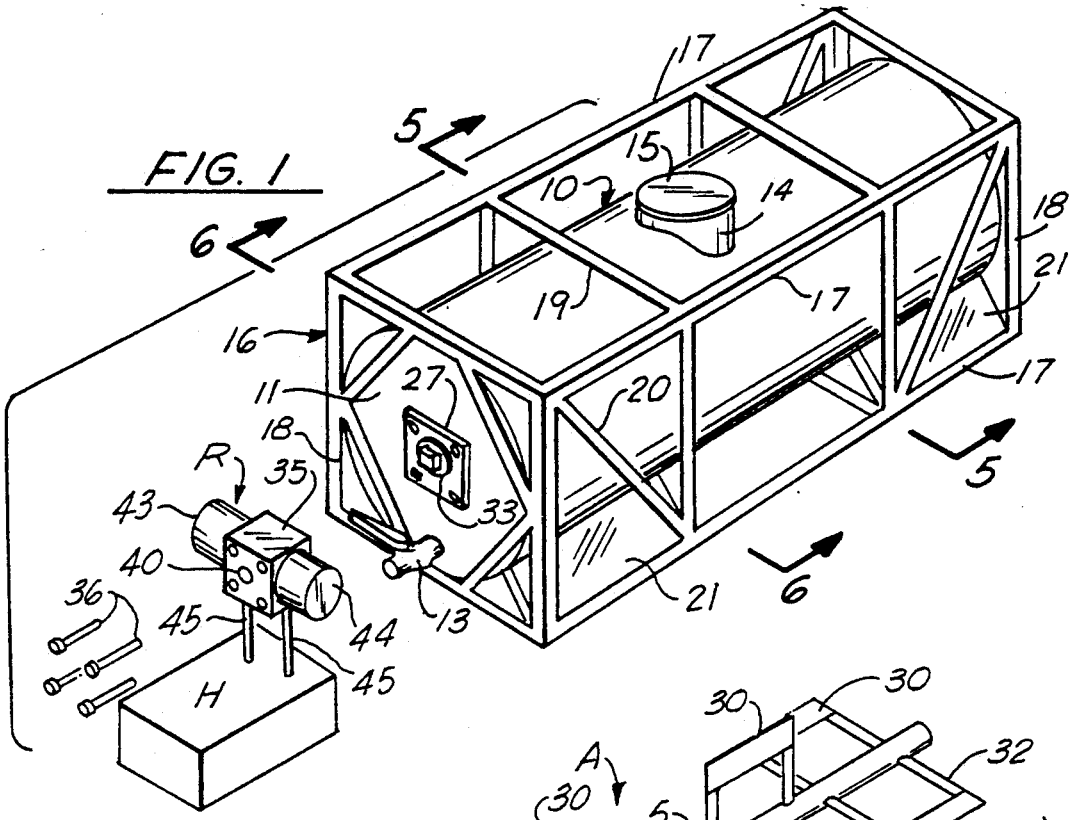
FIG. 1 is an exploded perspective view of the Container-Blender of the present invention, with its removable oscillating drive means.

And FIGS. 5 and 6 are sectional views of the container and paddle system taken as indicated by lines 5—5 and 6—6 on FIG. 1.

PREFERRED EMBODIMENT

Referring now to the drawings, this invention provides a Container-Blender for processing slurries by agitating an admixture of liquid and solids that tend to separate and thereby perfect the blend thereof for processing and/or off-loading. FIG. 1 of the drawings illustrates a typical container configuration adapted for bulk processing and/or shipment, a container 10 of shipboard size with a capacity of several thousand gallons and characterized by a horizontally disposed cylindrical shell closed by opposite ends 11 and 12. The front end is provided with a large diameter discharge 13 for example a plug valve with its operating handle shown in a closed position. Discharge is by gravity from the lower interior portion of the container. Charging of the container is through a hatch tower 14 closed by a removable cover 15 of large diameter. The cylindrical container shell is protectively carried within a cage 16 comprised of four equally spaced and parallel corner rails 17 joined by front and back frames 18 of rectangular configuration braced by suitable cross members 19 and trusses 20. The container is supported from and within the cage 16 by struts 21, as shown. Variations of this cage can be made as circumstance may require.

Figure 2:
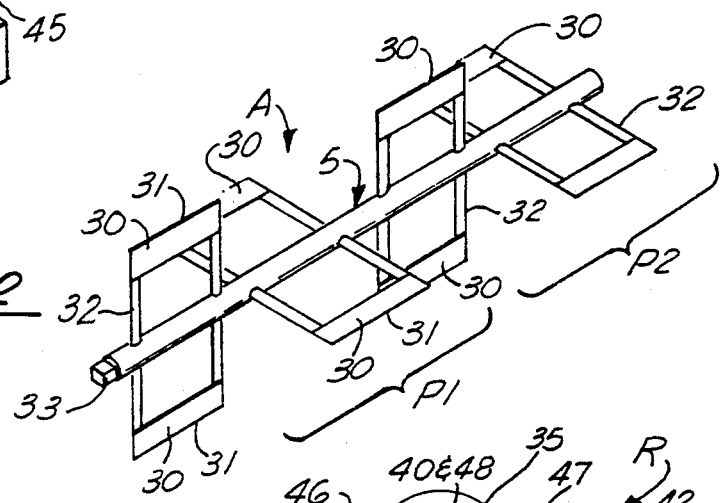
FIG. 2 is a perspective view of the rotatable paddle system, removed from the container.

Referring now to FIG. 2 of the drawings, this Container-Blender is characterized by an agitator A that provides a lift and shift function for moving the fluid mass within the container shell 10, whereby admixing of the liquid and solids efficiently produces the desired blend. That is, solubles and insolubles are evenly blended with a liquid, regardless of their natural tendency to separate. To this end the agitator A is comprised of complementary paddle systems, a front paddle system P1 and a rear paddle system P2. The paddle systems P1 and P2 occupy the front and rear interior portions of the container interior respectively, and they operate together so as to circulate the fluid mass therein toward the top center of the container interior, from the opposite end portions thereof. That is, the fluid mass is lifted at the end portions of the container and caused to flow towards the center portion by virtue of gravity.

In accordance with this invention, the agitator A is comprised of a rotatable shaft S journaled concentric within and coextensive of the central axis of the container, a tubular shaft S for horizontal beam strength and high torque capability. As shown in FIG. 4 of the drawings, the closed opposite ends 11 and 12 of the container are provided with bearing means B1 and B2 so as to rotatably carry the shaft S, and with packing glands G1 and G2 sealing the bearings from the interior of the container. In practice, the bearing means and glands are alike at opposite ends of the container, and comprised of a housing 22 welded into the container end and with a flat bulkhead 23 disposed in a plane normal to the shaft axis and exposed to the interior of the container, the front bulkhead opposing the rear bulkhead. The bearing means B1 and B2 are carried at the exterior of the bulkheads while the glands G1 and G2 are carried so as to be exposed at the interior thereof. The bearing means are preferably commercial anti-friction ball bearings or the like, while the glands are packings 24 compressed by axially adjustable sleeves 25 positioned by screw means 26. The front housing 22 is closed by a mounting plate 27 with an opening through which the shaft S is accessible, while the rear housing 22 is closed by an imperforate protection plate 28.

As shown in FIGS. 4 and 5, the center of the shaft S is stabilized by a bearing means B3 carried by diagonal struts 29 extending radially to the container shell 10. The bearing means B3 is preferably an anti-friction sleeve of Teflon (TM) or the like, positioned between and separating the two paddle systems P1 and P2. Accordingly, the shaft S is stabilized to ensure concentricity with the inner diameter wall of the container shell 10.

In accordance with this invention, each paddle system P1 and P2 operates in its assigned interior end portion of the container 10, adjacent to the end walls 11 and 12 thereof, to lift the fluid mass by means of limited rotation thereof. The lifted mass inherently flows away from the confining end 11 and 12 and towards the open center portion of the container interior, there being a dwell during reversal of rotation that provides time for this function. Note however, that continued rotation in one direction will push the lifted mass over center so as to defeat the aforesaid function of the mass shifting toward the center of the container interior.

In practice, each paddle is a flat blade 30 disposed in a plane substantially coincidental with and extending radially from the axis of shaft S, the center axis of the container shell 10. The flat blade 30 is of substantial longitudinal extent and has a straight outer edge 31 disposed closely adjacent to but not touching the inner diameter wall of the container shell 10, so as to have a juxtaposed wiping action over said wall. Thus, the fluid mass is effectively lifted within the container wall when the paddle 30 moves upwardly in close relation thereto.

In accordance with this invention, the paddle systems P1 and P2 are double acting, by oscillation through a limited degree of turning, to alternately lift the fluid mass at opposite sides of the container shell 10. To this end, the paddle alternately wipes upwardly (and downwardly) at diametrically opposite side walls of the container shell 10. A feature of this invention is the limited rotation of the paddle systems P1 and P2, shown in the drawings as pairs of diametrically opposite paddles 30 carried by arms 32 fixed to the shaft S so as to alternately lift the fluid mass at opposite sides of the container interior. In practice, each paddle 30 is carried from its opposite ends by a pair of spaced radial arms 32, said arms extending diametrically to carry the oppositely arranged paddles 30 for reciprocal turning within the container.

In accordance with this invention, and as best illustrated in FIG. 2 of the drawings, each paddle system P1 and P2 is comprised of two pairs of paddles 30 as hereinabove described, all within its respective container end portion. A feature of this plural arrangement is that the pairs of paddles 30 are fixed to shaft S in angularly displaced planes. As shown, these planes are angularly displaced 90°, so that the fluid mass lifted by the endmost pair of paddles flows longitudinally by gravity therefrom to be engaged and lifted again by the innermost pair of paddles, and to then flow to the center portion of the container interior for recirculation to the bottom portion thereof. As a result, there is a vortex-like action that emanates from opposite ends of the container to circulate the fluid mass through the center portion thereof.

An oscillating drive means is provided to reversely turn the paddle systems P1 and P2 within a limited range of 90° to 360° rotation as may be required. Such a means is shown herein as a rotary actuator R operated by hydraulic pressure from a power means H. The actuator R and power means H are employed for their compactness and portability, all of which is conducive to their adaptability to attachment to and detachment from the container 10. For example, the drive means can be removed during transport, and then applied for off-loading and/or further blending. Therefore and in accordance with this invention, the shaft S is provided with a coupling means and preferably a squared end 33, and the actuator R is provided with a mating coupling means and preferably a squared socket 34. The body 35 of the actuator R is complementary to the mounting plate 27 carried by the front housing 22 where the shaft end 33 is exposed through the opening in said plate. Accordingly, the actuator body 35 is offered up to the plate 27 for engagement of the socket 34 with the shaft end 33, and secured in working position as by fastening means such as screw bolts 36 at each of four corners thereof.

Figure 3:
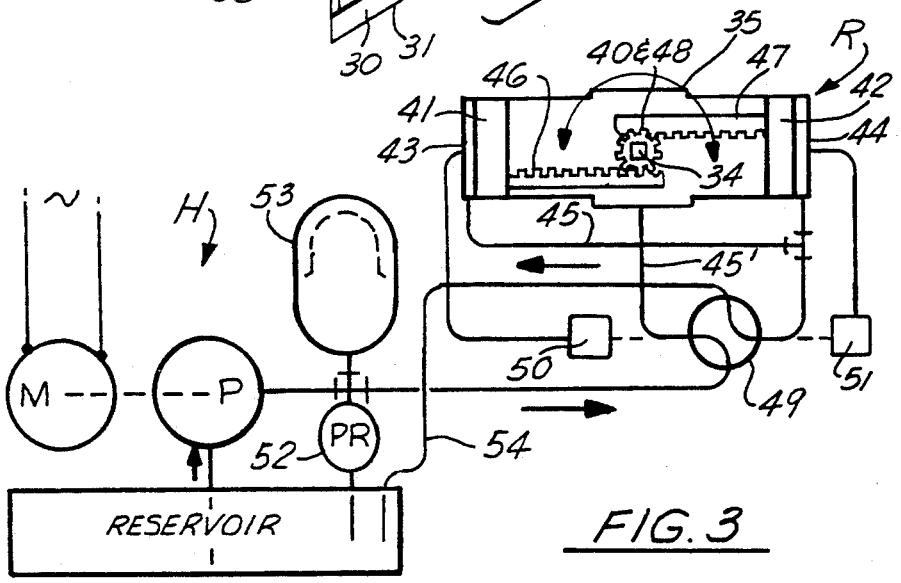
FIG. 3 is a diagramtic view of the oscillating drive means.

The rotary actuator R is diagramed in FIG. 3 as comprised of a dual rack and pinion drive with oppositely shifting pistons operating in alignment at diametrically opposite sides of a drive hub. As shown, there is a drive hub 40 journaled in the actuator body 35 with the socket 34 exposed for coupled engagement with the squared shaft end 33. The two pistons 41 and 42 operate in opposite cylinder bores closed by heads 43 and 44 open to a first hydraulic line 45. A second hydraulic line 45′ opens between the pistons in communication through the body 35. The racks 46 and 47 extend from pistons 41 and 42 to engage the pinion 48 at opposite sides, whereby rotation of the hub, limited by the piston stroke, results from simultaneous shifting of said pistons. A reversing valve 49 reverses flow through lines 45 and 45′, responsive to position or presssure sensors 50 and 51 at opposite ends of the cylinders. Hydraulic pressure from the power means H is by a pump P operated by a prime mover such as a motor M. The pump suction is from a reservoir, with a pressure by-pass 52 from the pump to said reservoir. A pressure accumulator 53 ensures hydraulic flow during intermittent operation, with a minimized pumping capacity required. Return of expended fluid is by a line 54 to the reservoir. It is to be understood that this drive means will vary in detail as may be required.

From the foregoing it will be understood how the paddle systems P1 and P2 cause the slurry to flow toward the center portion of the container interior, while sweeping the container walls and with a vortex-like action pulling the fluid mass inward. Contamination is avoided by isolating the bearing means B1 and B2 with the glands G1 and G2. Agitator motion is minimized with the use of the rotary actuator R that oscillates the paddle systems within a limited angle of reverse turning. Although the commodity to be blended is viscous, the paddle systems are somewhat light weight in construction, permitted by the flow of the fluid mass once the initial inerta is overcome. With the pressure controlled accumulation of hydraulic fluid the fluid mass is started in motion at a slow rate and increased to whatever rate is desired, all of which occurs at each reversal of the actuator. The sweeping function of the paddle systems precludes any accumulation of residue, and ensures complete blending.

Having described only the typical preferred form and application of my invention, I do not wish to be limited or restricted to the specific details herein set forth, but wish to reserve to myself any modifications or variations that may appear to those skilled in the art, as set forth within the limits of the following claims.

I claim:

1. The method of shipping and processing a slurry fluid mass comprised of separable insolubles in a liquid carrier, including the steps of:

a. providing a container-blender, comprising:

container means for containing said slurry fluid mass, said container means comprising a horizontally disposed container shell closed at opposite ends, and an interior having an inner wall, a central portion, and a bottom portion, said container shell further comprising a mounting plate situated at one of said ends of said container shell, said container means further comprising a substantially rectilinear protective frame structure fixedly enveloping said container shell;

an agitator comprising a paddle system within the interior of said container shell, said paddle system comprising first and second pairs of paddles, each pair of paddles comprising first and second paddles disposed in a common plane in directly opposing, lateral fashion from a shaft, the plane in which said second pair of paddles are disposed being oriented at a discrete angle relative to the plane in which the first pair of paddles are disposed, said shaft being rotatable along a central, longitudinal axis of said container shell, each of said paddles having an edge juxtaposed to and sweeping close to the inner wall of said container shell; and oscillating means for reversely rotating said agitator through a limited range of angular displacement, said oscillating means further comprising a drive linkage projecting from said container shell in the vicinity of said mounting plate, said drive linkage being connected to said shaft, said oscillating means further comprising a portable drive means configured to removeably connect with said drive linkage and said mounting plate;

b. charging said container shell with said fluid mass comprised of insolubles in a liquid carrier;

c. transporting said container shell with said fluid mass therein, comprising the steps of lifting and manipulating said container means via the application of lifting and manipulating force to said rectilinear protective frame structure, and allowing said rectilinear frame structure to support, cradle, and protect said container shell;

d. oscillating said agitator, comprising the steps of coupling said portable drive means to said drive linkage and said mounting plate, actuating said portable drive means and providing rotational force to said shaft via said drive linkage;

reversely rotating the shaft and paddle system through a limited range of angular displacement via said portable drive means and drive linkage, by changing the direction of rotation of said portable drive means at a predetermined interval;

e. displacing and distributing said fluid mass by reversely rotating said first pair of paddles, lifting and sweeping said first pair of paddle edges near said inner wall of said container shell, circulating said fluid mass away from the interior bottom portion of said container shell, and reversely rotating said second pair of paddles, lifting and sweeping said second pair of paddle edges near said inner wall of said container shell, lifting said fluid mass, and circulating said fluid mass away from the interior bottom portion of said container shell, said circulation of said fluid mass by said second pair of paddles interacting with the circulation of said fluid generated by the lifting and sweeping action of said first pair of paddles thereby generating a through admixing of said fluid mass, and circulating the fluid mass through said central portion of said container shell;

f. blending the separate insolubles into a substantially homogeneous liquid; and g. uncoupling said portable drive means from said drive linkage and said mounting plate.

2. The method of shipping and processing a slurry fluid mass comprised of separable insolubles in a liquid carrier, including the steps of:

a. providing a container-blender, comprising:

container means for containing said slurry fluid mass, said container means comprising a horizontally disposed container shell closed at opposite ends, and an interior having an inner wall, a central portion, and a bottom portion, said container shell further comprising a mounting plate situated at one of said ends of said container shell, said container means further comprising a substantially rectilinear protective frame structure fixedly enveloping said container shell;

an agitator comprising a paddle system within the interior of said container shell, said paddle system comprising first and second pairs of paddles, each pair of paddles comprising first and second paddles disposed in a common plane in directly opposing, lateral fashion from a shaft, the plane in which said second pair of paddles are disposed being oriented at a discrete angle relative to the plane in which the first pair of paddles are disposed, said shaft being rotatable along a central, longitudinal axis of said container shell, each of said paddles having an edge juxtaposed to and sweeping close to the inner wall of said container shell; and oscillating means for reversely rotating said agitator through a limited range of angular displacement, said oscillating means further comprising a drive linkage projecting from said container shell in the vicinity of said mounting plate, said drive linkage being connected to said shaft, said oscillating means further comprising a portable drive means configured to removeably connect with said drive linkage and said mounting plate, said portable drive means further comprising a housing containing a dual rack and pinion drive comprising first (46) and second (47) racks in generally parallel alignment, and a drive hub (34), said first (46) and second (47) racks being connected to first (41) and second (42) reciprocating pistons, respectively; said first (46) and second (47) racks being engaged with diametrically opposed sides of said drive hub;

b. charging said container shell with said fluid mass comprised of insolubles in a liquid carrier;

c. transporting said container shell with said fluid mass therein, comprising the steps of lifting and manipulating said container means via the application of lifting and manipulating force to said rectilinear protective frame structure, and allowing said rectilinear frame structure to support, cradle, and protect said container shell;

d. oscillating said agitator, comprising the steps of removably affixing the housing of said portable drive means to said mounting plate, and coupling the drive hub of said portable drive means to said drive linkage, actuating said portable drive means and providing rotational force to said shaft via said drive linkage;

reversely rotating the shaft and paddle system through a limited range of angular displacement via said portable drive means and drive linkage by alternately actuating said first and second reciprocating pistons, oscillating said first and second racks in opposing directions about said drive hub, and oscillating said drive hub in opposing rotational directions;

e. displacing and distributing said fluid mass by reversely rotating said first pair of paddles, lifting and sweeping said first pair of paddle edges near said inner wall of said container shell, circulating said fluid mass away from the interior bottom portion of said container shell, and reversely rotating said second pair of paddles, lifting and sweeping said second pair of paddle edges near said inner wall of said container shell, lifting said fluid mass, and circulating said fluid mass away from the interior bottom portion of said container shell, said circulation of said fluid mass by said second pair of paddles interacting with the circulation of said fluid generated by the lifting and sweeping action of said first pair of paddles thereby generating a thorough admixing of said fluid mass, and circulating the fluid mass through said central portion of said container shell;

f. blending the separate insolubles into a substantially homogeneous liquid; and g. uncoupling the drive hub and housing of said portable drive means from said drive linkage and said mounting plate.

* * * * *